US012806499B2

(12) United States Patent
Woods

(10) Patent No.: US 12,806,499 B2
(45) Date of Patent: Nov. 24, 2026

(54) CALF SECURED SIT-UP PUNCHING TARGETS

(71) Applicant: Byron Woods, Eastvale, CA (US)

(72) Inventor: Byron Woods, Eastvale, CA (US)

( * ) Notice: Subject to any disclaimer, the term of this patent is extended or adjusted under 35 U.S.C. 154(b) by 241 days.

(21) Appl. No.: 18/604,922

(22) Filed: Mar. 14, 2024

(65) Prior Publication Data

US 2024/0307737 A1 Sep. 19, 2024

Related U.S. Application Data

(60) Provisional application No. 63/452,629, filed on Mar. 16, 2023.

(51) Int. Cl.

| | |
|---|---|
| ***A63B 69/26*** | (2006.01) |
| ***A63B 69/32*** | (2006.01) |
| ***A63B 71/06*** | (2006.01) |

(52) U.S. Cl.

CPC ..... *A63B 69/26* (2013.01); *A63B 69/322* (2022.08); *A63B 71/0622* (2013.01); *A63B 2071/0625* (2013.01); *A63B 2209/10* (2013.01); *A63B 2220/17* (2013.01); *A63B 2220/53* (2013.01); *A63B 2220/62* (2013.01); *A63B 2220/833* (2013.01); *A63B 2225/74* (2020.08)

(58) Field of Classification Search

CPC ..... A63B 69/20–34; A63B 23/0211; A63B 71/0622; A63B 71/08; A63B 2071/0625; A63B 2209/10; A63B 2220/17; A63B 2220/53; A63B 2220/62; A63B 2220/833; A63B 2225/74; A41D 13/0543; A41D 13/06; A41D 13/065

See application file for complete search history.

(56) References Cited

U.S. PATENT DOCUMENTS

| | | | | |
|---|---|---|---|---|
| 4,913,419 | A | 4/1990 | McAuliffe | |
| 6,033,348 | A | 3/2000 | Warshauer | |
| 7,591,768 | B1 | 9/2009 | Geeting | |
| 8,696,422 | B1 * | 4/2014 | Santiago | A63B 71/10 273/455 |
| 9,814,959 | B1 | 11/2017 | Riera | |
| 10,086,251 | B2 * | 10/2018 | Allen | G01S 13/72 |

(Continued)

FOREIGN PATENT DOCUMENTS

| | | | | |
|---|---|---|---|---|
| JP | 2014061013 A | * | 4/2014 | |
| WO | WO-2017081555 A1 | * | 5/2017 | A63B 71/12 |
| WO | WO-2019158977 A1 | * | 8/2019 | G16H 20/30 |

*Primary Examiner* — Megan Anderson
*Assistant Examiner* — Kathleen M Fisk
(74) *Attorney, Agent, or Firm* — Kirk A. Buhler; Buhler & Associates Patenting

(57) ABSTRACT

Improvements in a calf secured sit-up punching targets to provide an exercise device that allows a user to punch as they perform a sit-up or crunch. This allows a user to combine two exercises at the same time. The exercise uses stomach muscles in the crunch, arms in punching and allows for targeting punches. The targets are secured to a sock and skeletal frame that is securable to the lower leg or calf area of a user. The target(s) are on surface pads or on a shaft that extends from the leg support. The shaft has rotational pins to the target that can be arranged for front punches, angled punches or side roundhouse punches. The targets are on removable flex shaft that flexes or rotates to absorb some of the impact and the target can then return to a neutral position.

12 Claims, 6 Drawing Sheets

(56) References Cited

U.S. PATENT DOCUMENTS

| | | | | |
|---|---|---|---|---|
| 11,497,964 | B1 * | 11/2022 | Hunter | A63B 53/005 |
| 11,642,582 | B2 * | 5/2023 | Margareten | A63B 69/32<br>273/440.1 |
| 11,839,804 | B2 * | 12/2023 | Morin | A63B 69/32 |
| 11,938,391 | B2 * | 3/2024 | McFarlane | A63B 71/14 |
| 2019/0168094 | A1 | 6/2019 | Coles | |
| 2023/0079575 | A1 * | 3/2023 | Kamara | A63B 24/0062<br>482/8 |

* cited by examiner

CALF SECURED SIT-UP PUNCHING TARGETS

CROSS-REFERENCE TO RELATED APPLICATIONS

This application claims the benefit of Provisional Application Ser. No. 63/452,629 filed Mar. 16, 2023, the entire contents of which is hereby expressly incorporated by reference herein.

PRIOR ART

U.S. Published application 20190168094 was published on Jun. 6, 2019, to Robert Thomas Coles and is titled Athletic Device for Practicing Punching and Striking. This published application discloses a device equipped with punch-absorbing striking pads for practicing punching and striking. More specifically, the present invention is directed at a device equipped with punch-absorbing striking pads and attached to a decline bench; thus, allowing a user to practice punching and striking while doing sit-ups. While this publication allows for punching a target while performing sit-ups the targets are secured to a decline bench and not on the user.

U.S. Pat. No. 9,814,959 issued on Nov. 14, 2017, to Javier Riera and is titled Exercise and Training Device. This patent discloses an exercise and training device. The exercise and training device is adapted to be removably mounted to a vertical structure. The exercise and training device includes a paddle member that provides target surfaces; a support member that facilitates in aligning of the exercise and training device when mounted to the vertical structure; and a mounting member that mounts the exercise and training device about the vertical structure. While this patent discloses punching targets, they are mounted onto a vertical structure and not on the legs of a user.

U.S. Pat. No. 4,913,419 issued on Apr. 3, 1990, to Patrick McAuliffe and is titled Striking Apparatus with Variably Resistant Resilient Joint. This patent discloses a striking apparatus includes a resilient joint between a support and a strike receiving target. The hinge member has two resilient leaves joined to each other and retaining the target therebetween. A set of central stiffeners on the hinge leaves defines the preferential hinge axis. The apparatus includes a base section with a support arm which is attachable through a bracket to a vertical support. Posts extending perpendicular to planar plates defining the support and the target carry changeable dampers in the form of bands, O-rings or flexible rods, for user selection of target resistance. The punching targets do not have a mounting structure for securing on the lower legs of a user.

What is needed is a punching target that can be mounted onto the legs of a user so they can punch the target as they perform sit-ups or crunches. The calf secured sit-up punching targets disclosed in this document provides the solution.

BACKGROUND OF THE INVENTION

Mashal arts requires a number of mixed exercises to condition an athlete. In some mixed martial arts events, a competitor will need to punch from both a standing position and a seated position. It is also important to maximize exercises by combining exercises such as sit-ups or crunches with punching exercises. While some athletes have a spotter or assistant that can hold a punching bag or target, other athletes exercise alone. For these single athletes they must both hold the target and punch or secure a target to a static support structure.

SUMMARY OF THE INVENTION

It is an object of the calf secured sit-up punching targets to provide an exercise device that allows a user to punch as they perform a sit-up or crunch. This allows a user to combine two exercises at the same time. The exercise uses stomach muscles in the crunch, arms in punching and allows for targeting punches.

It is an object of the calf secured sit-up punching targets to include a securing mechanism that allows the target(s) to be removably secured to the lower leg or calf area of a user. Securing the targets to the lower leg or calf area places the targets at an ideal position near the end-of-reach of the user to ensure proper technique.

It is an object of the calf secured sit-up punching targets to include a shin support structure that is secured to a stirrup sock. The use of a stirrup sock sets the bottom location around the arch of the foot of the user. It also provides a secure position of the target to reduce rotation of the target from the minimal compression of the sock around the foot and lower leg of the user.

It is an object of the calf secured sit-up punching targets for the targets to be adjustable for rotation relative to the legs of a user. The target is on a shaft that extends from the leg support. The shaft has rotational pins to the target that can be arranged for front punches, 45-degree angled punches or side roundhouse punches.

It is an object of the calf secured sit-up punching targets for the targets to have flexibility when they are punched. The allows for the targets to flex or rotate to absorb some of the impact and the target can then return to a neutral position that the perpendicular to the leg or shin bone of the user.

It is another object of the calf secured sit-up punching targets is for the targets to be removable to allow the user to use the calf structure without the targets extending therefrom. Removing the target and leaving a mounting stub allows the user to move to a different exercise without the target extending forward from the lower leg of the user.

It is still another object of the calf secured sit-up punching targets to include a hook-and-loop fastening system to secure the calf support above and/or below the calf muscle of a user. The hook-and-loop fasteners allow for easy positioning and securing the targets on the leg of a user and adjust for different physical geometry of a user to provide a custom fit for each user.

Various objects, features, aspects, and advantages of the present invention will become more apparent from the following detailed description of preferred embodiments of the invention, along with the accompanying drawings in which like numerals represent like components.

DETAILED DESCRIPTION OF THE INVENTION

Figure 1:
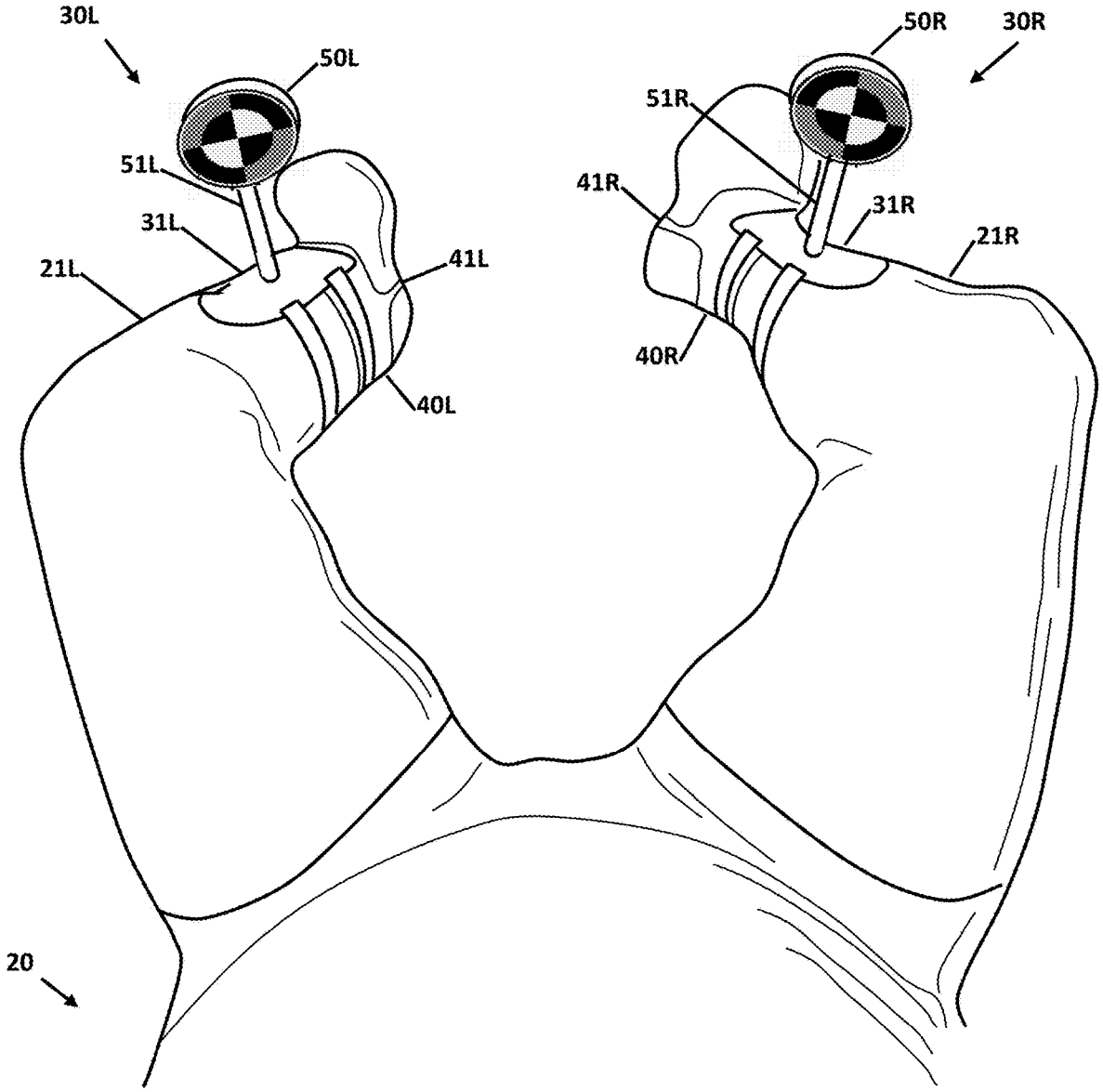
FIG. 1 shows a calf secured sit-up punching targets on a user.

It will be readily understood that the components of the present invention, as generally described and illustrated in the drawings herein, could be arranged and designed in a wide variety of different configurations. Thus, the following more detailed description of the embodiments of the system and method of the present invention, as represented in the drawings, is not intended to limit the scope of the invention but is merely representative of various embodiments of the invention. The illustrated embodiments of the invention will be best understood by reference to the drawings, wherein like parts are designated by like numerals throughout.

While this technology is susceptible of embodiment in many different forms, there is shown in the drawings and will herein be described in detail several specific embodiments with the understanding that the present disclosure is to be considered as an exemplification of the principles of the technology and is not intended to limit the technology to the embodiments illustrated. The terminology used herein is for the purpose of describing particular embodiments only and is not intended to be limiting of the technology. As used herein, the singular forms "a," "an," and "the" are intended to include the plural forms as well, unless the context clearly indicates otherwise.

It will be further understood that the terms "comprises," "comprising," "includes," and/or "including," when used in this specification, specify the presence of stated features, integers, steps, operations, elements, and/or components, but do not preclude the presence or addition of one or more other features, integers, steps, operations, elements, components, and/or groups thereof. It will be understood that like or analogous elements and/or components, referred to herein, may be identified throughout the drawings with like reference characters.

| Item Numbers and Description | |
|---|---|
| 20 user | 21, 21L, 21R leg |
| 30, 30L, 30R punching target | 31, 31L, 31R shin structure |
| 32 lower strap | 33L upper strap |
| 34 34L frame | 35L side of frame |
| 36L slot | 37L slot |
| 40, 40L, 40R sock | 41, 41L, 41R stirrup |
| 42L heel relief | 43L foot relief |
| 44L leg opening | 45L 45R stitching |
| 49 cell phone | 50, 50L, 50R target |
| 51, 51L, 51R post | 52 socket |
| 53 pin | 54 spring |
| 55 spring | 56 hole(s) |
| 57 socket opening | 60 shin structure |
| 61 upper left pad | 62 upper right pad |
| 63 lower right pad | 64 lower left pad |
| 67 signal | 89 antenna |
| 69 transmitter | 70 front target pad |
| 71 hook and loop | 72 hoop and loop strap |
| 73 lower hook and loop | 74 wrapped strap |
| 75 power | 76 speaker |
| 77 antenna | 78 transceiver |
| 79 computer/phone/tablet | 80 controller |
| 81-84 sensors | 86-89 LED |
| 97 wrap | 98 depressed |
| 99 turn | |

FIG. 1 shows a calf secured sit-up punching targets on a user 20. This is a perspective view from a user 20 as they view the punching target(s) 30L, 30R or impact receiving member. In the figures the punching target(s) and other components are identified as an item number such as target 30 to generically identify the item. The same target 30 can be described as target 30L to identify the target 30 on the left or target 30R to identify the target 30 on the right side. In general, the skeletal frame 34L, 34R is constructed on a sock 40L, 40R and can be either universally configured for use on either leg 21L, 21R or can be configured for a specific left leg 21L or right leg 21R. The specific details and construction are shown and described in other figures herein. This figure provides a general understanding of the calf secured sit-up punching targets 30L, 30R on a user 20.

Placing the punching targets 30L, 30R on the lower legs 21L, 21R of a user 20 allows the user to combine sit-ups or crunches with punching the targets with each sit-up. The user 20 can punch straight to a target 30L, 30R or can cross to an opposing target on the opposite leg 21L, 21R. User 20 can also perform multiple combination punches. The targets 50L, 50R are shown as round targets, but could take a variety of shapes. The targets 50L, 50R can also be padded or from a dense material. The targets 50L, 50R are shown connected to posts 51L, 51R. The posts 51L, 51R can be flexible to allow the targets to bend or flex when impacted with a punch.

The posts 51L, 51R are secured in receivers in a socket that are shown and described in more detail in other figures herein. The receivers are secured on a skeletal shin structure 31L, 31R that retains the position of the posts 51L, 51R in a perpendicular relationship to the skeletal shin structure 31L, 31R. The skeletal shin structure 31L, 31R is secured to a flexible sock 40L, 40R that fits around the lower leg 21L, 21R calf and shin of a user 20. In the embodiment shown the flexible sock 40L, 40R is configured as a stirrup 41L, 41R that passes under the arch of a user. While a stirrup type sock is shown and described of types of socks are contemplated. The stirrup sock also allows the structure to fit over the shoe of a user.

Figure 2:
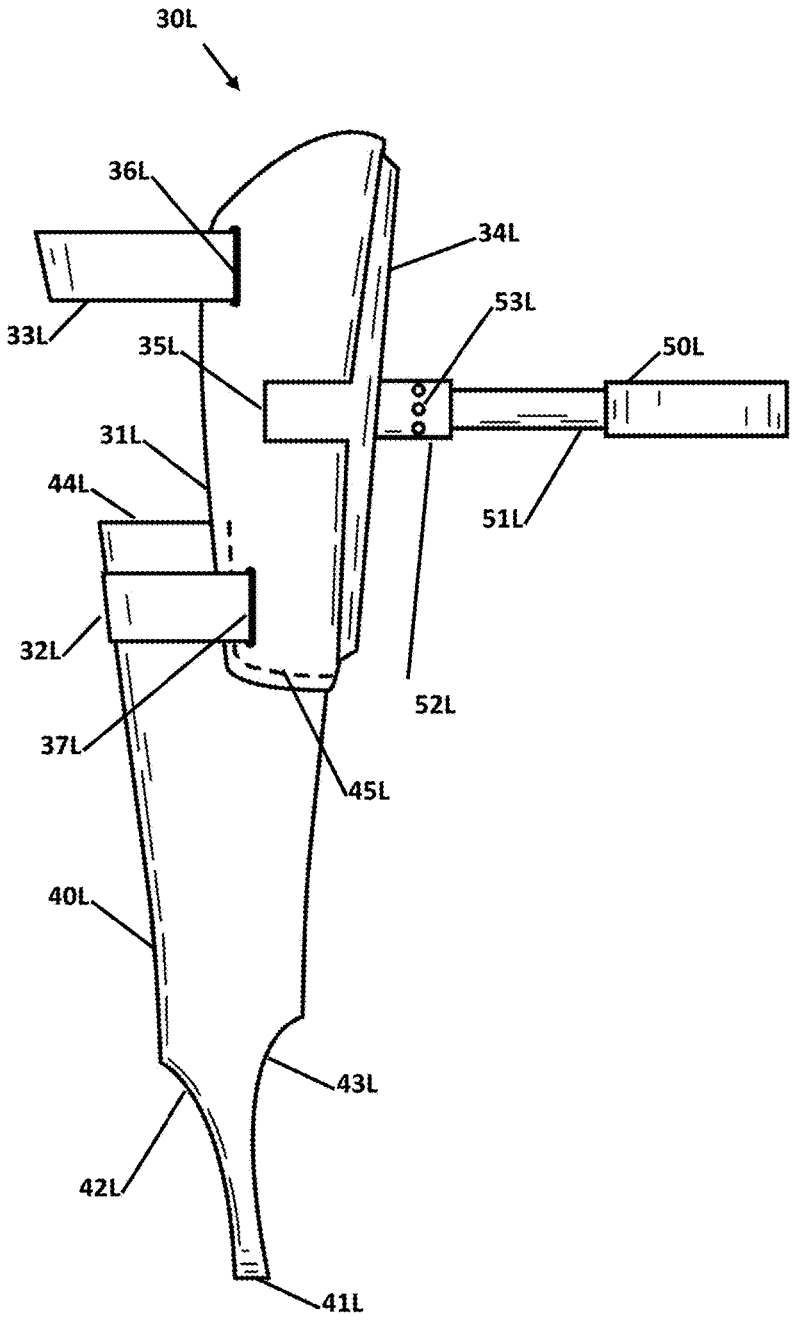
FIG. 2 shows side view of the calf secured sit-up punching target.
Figure 3:
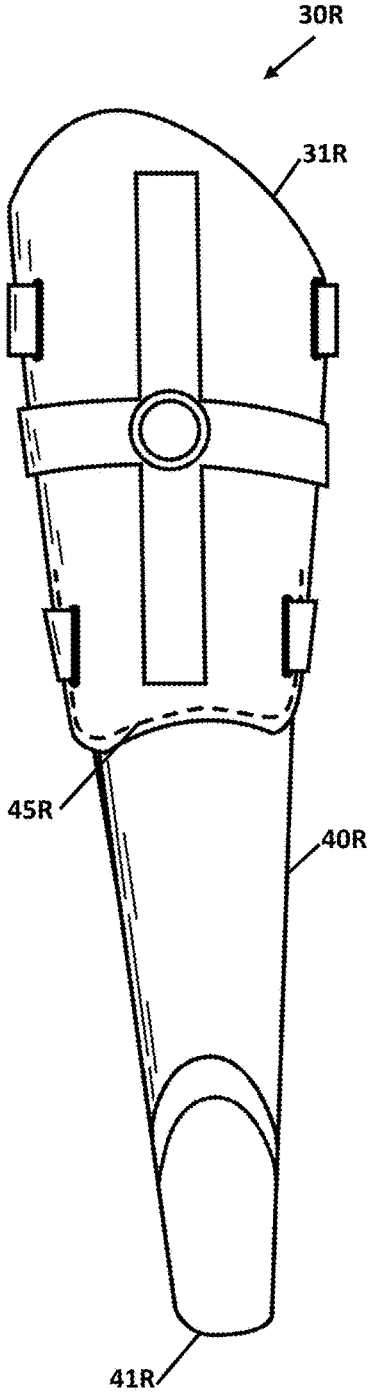
FIG. 3 shows a front view of the calf secured sit-up punching target.

FIG. 2 shows a side view of the calf secured sit-up punching target 30L and FIG. 3 shows a front view of the calf secured sit-up punching target with the target removed for clarity. While a specific left target 30L or right target 30R is shown, it should be understood that the left target 30L or right target 30R could be mirror images or could be the same target 30 placed on either the left or right leg of a user.

The lower part of these figures shows the sock 40L, 40R that fits on and around the lower leg of a user. This specific embodiment shows a stirrup 41L 41R that fits under the arch of a user and could be installed over a shoe. The lower part of the sock 40L,40R is shown with a foot relief 43L and a heel relief 42L. While this specific embodiment with foot relief 43L and heel relief 42 is shown and described it does not limit the sock 40L, 40R for stretching around the leg of a user.

Stitching 45L, 45R is shown as a securing means to retain the sock 40L, 40R onto a more rigid shin structure 31L. The shin structure 31L contours around the shin or front lower leg of the user and spreads the load and target 50L structure. An upper strap 33L and a lower strap 32L are shown in the figure and add additional retention to the shin structure 31L. The upper strap 33L is shown passing through slot or hole 36L and the lower strap 32L is shown passing through slot or hole 37L in the shin structure 31L. The foot of the user passes through the upper strap 33L and into the leg opening 44L.

A skeletal structure having a frame 34L with side(s) 35L at least partially wrapped around the shin structure 31L to provide a contouring function around the lower leg and front shin bone of a user to reduce rotation. A receiver socket 52L is secured to the frame 34L. The socket 52L can be rigidly secured or secured through a flexible mounting or a spring. In the embodiment shown the socket 52L has a plurality of holes 53L where the post 51L can be mounted for a perpendicular relationship of the target 50L to the user or can be set at an angle for side or round-house punches. While a set of holes 53L is shown at 45 degrees angles of rotation, the angles can be more or less than 45 degrees.

The holes 53L allows for removal of the post 51L to make it easier for a user to remove the post 51L and target 50L or to change to a different post 51L and target 50L as needed. At the end of the post 51L is a target 50L. The target 50L is shown as round targets but could take a variety of shapes and include neither or different levels of padding.

Figure 4:
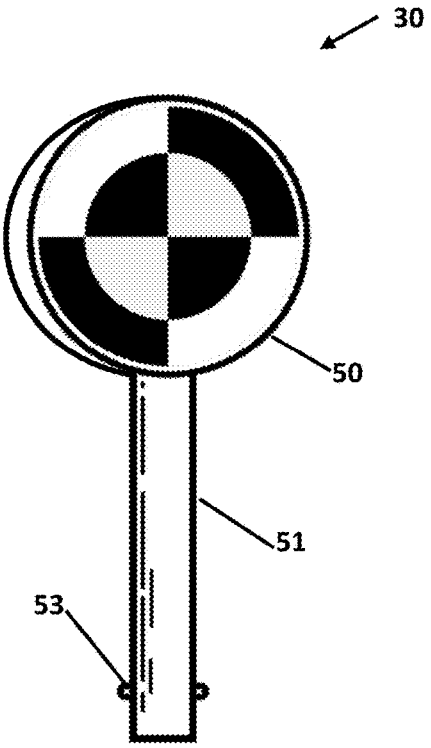
FIG. 4 shows a view of a punching target on the extension post.
Figure 5:
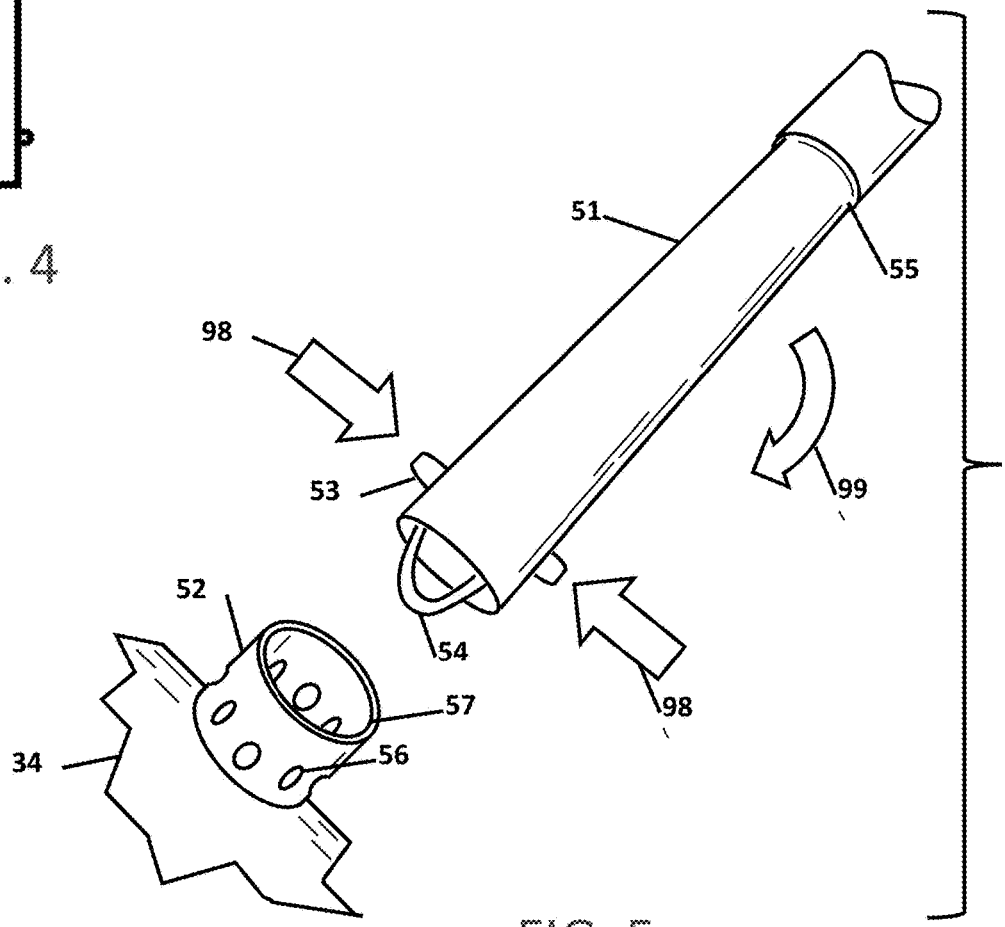
FIG. 5 shows an exploded view of the post and post securing system.

FIG. 4 shows a view of a punching target 30 on the extension post and FIG. 5 shows an exploded view of the post 51 and post 51 securing system. FIG. 4 shows post 51 with pins 53 at a first end that are extending out of the post 51. A target 50 is shown at the second end of the post 51. The target 50 is shown as round targets but could take a variety of shapes and include neither or different levels of padding.

From FIG. 5, post 51 is shown. At the lower left side of this figure the skeletal frame 34 is shown with the socket 52 extending thereon. Socket 52 is shown with a plurality of holes 56 extending around socket 52. The bottom of the post 51 shows a plurality of pins 53 that are biased by a spring 54 that pushes the pins 53 out of the post 51. The pins 53 are depressed 98 and the bottom or first end of the post 51 is passed into the inside diameter of the socket opening 57. Post 51 can be rotated 99 for the desired position of the target (not shown in this figure) and the pins 53 extended into the holes 56 in the socket 52 lock the position and rotation of the post 51. An optional spring 55 or other flexible member allows for some flexing and rotation of the target.

Figure 6A:
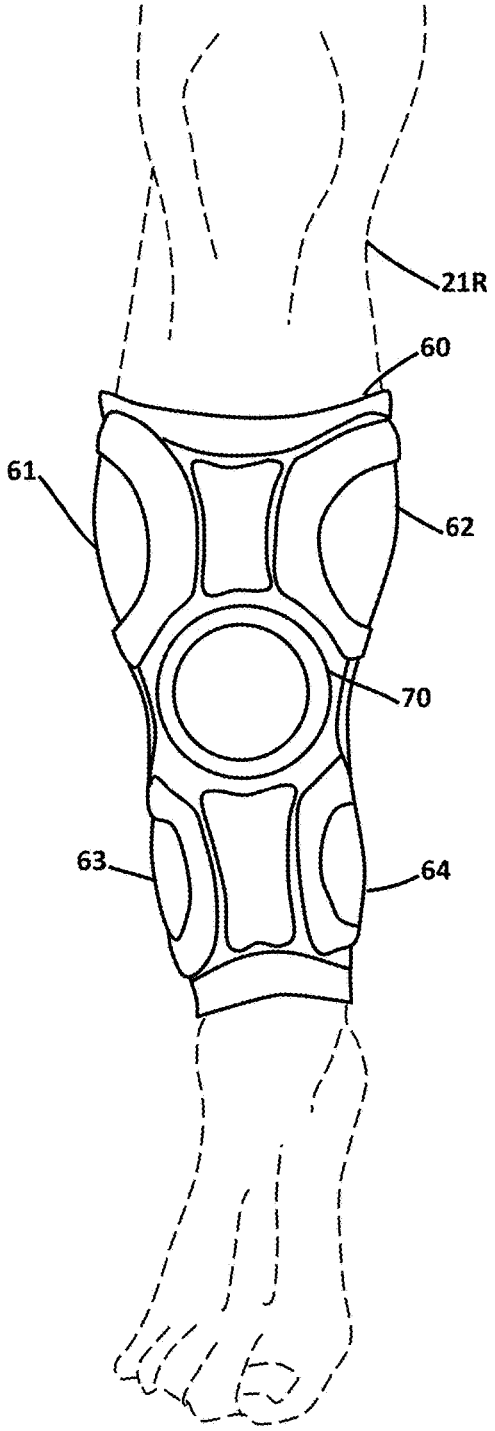
FIGS. 6A and 6B show a second preferred embodiment of the leg mounted punching targets.
Figure 6B:
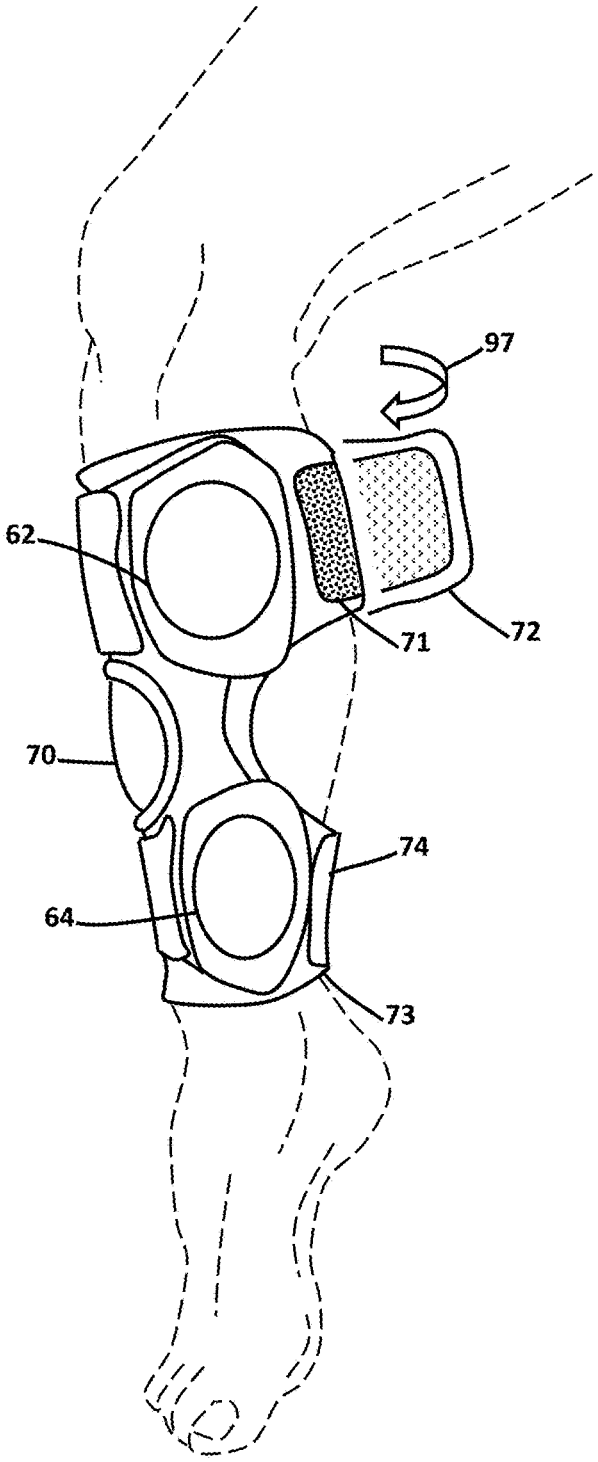

FIGS. 6A and 6B show a second preferred embodiment of the leg 21R mounted punching targets. These figures show a front (FIG. 6A) and a side view (FIG. 6B) of the preferred embodiment. In this embodiment the user can practice punching the targets 61-64 and 70 from a standing (as shown and described later) or sit-up position. The targets 61-64 and 70 are mounted on a semi-rigid skeleton shin structure 60. The under side of the shin structure 60 is made from breathable neoprene under wrap. The shin structure is designed to be machine washable, and linings are constructed using antimicrobial materials to assist with reducing odor and onset of mold/bacteria.

The target areas 61-64 and 70 are flexible plastic-coated foam. In one contemplated embodiment each sensor has an impact sensor, and in another further embodiment each pad 61-64 and 70 is intermittently illuminated to identify it as a (next) target for the user to practice eye-hand coordination. Around each target 61-64 and 70 is a flexible plastic-coated foam filled support structure.

The back of the shin structure 60 is a hook-and loop securing system with an upper hook-and-loop 71 that is secured with a hook-and loop strap 72 by wrapping 97 the hook-and loop strap 72 on the upper hook-and-loop 71. The lower part of the shin structure 60 has a similar securing system with a lower hook-and-loop 73 shown with a wrapped strap 74. The shin structure 60 is designed to fit on either leg 21R or 21L but could also be uniquely designed for a specific right or left lower leg. It is also contemplated that the pads can have water and air inflation capabilities and any other type of liquid substance. The hook-and-loop fastening system also allows for securing additional weights as a weighted shin guard underlay, using the hook-and-loop fastener or slotted openings in the shin structure 60.

Figure 7:
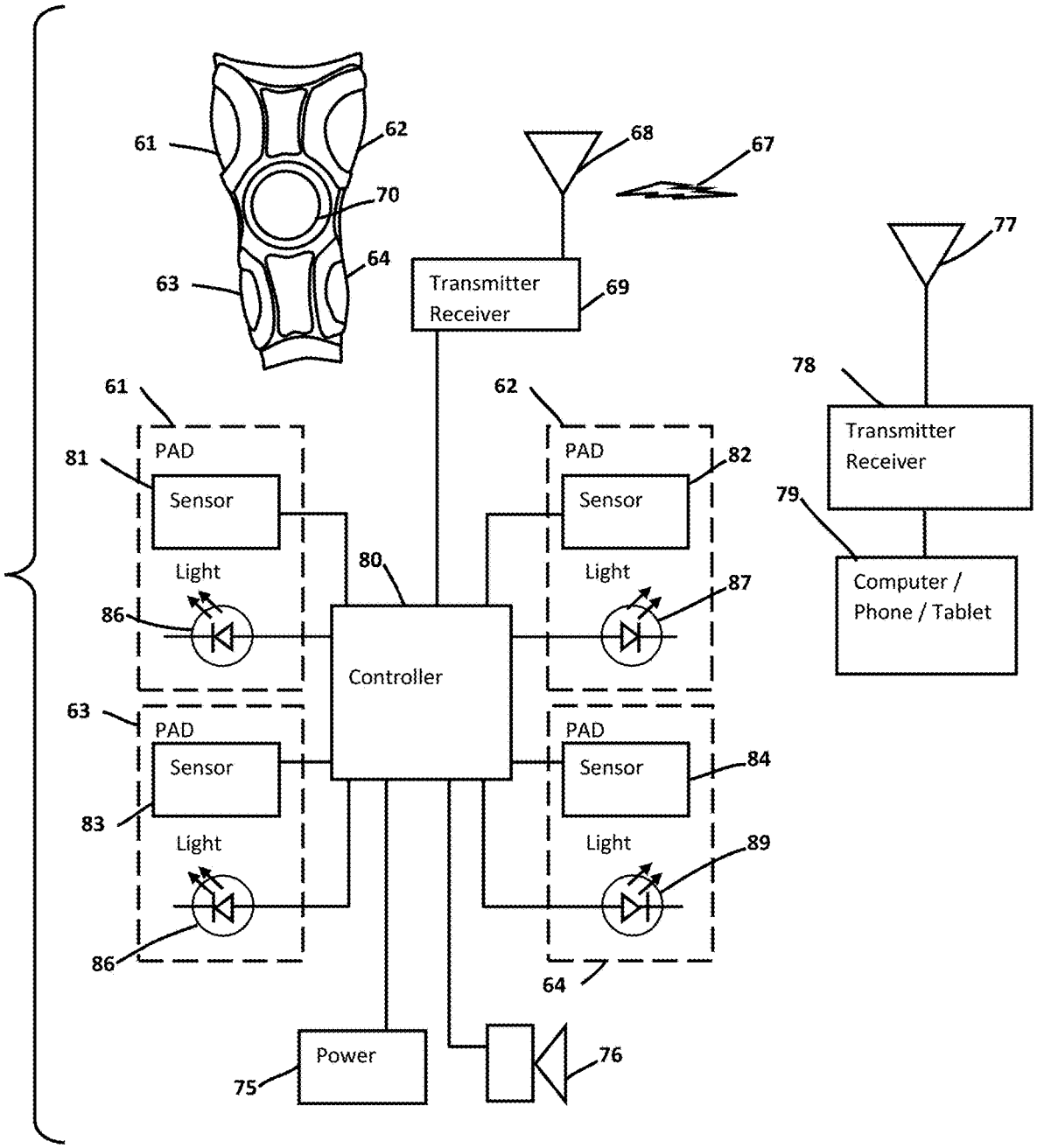
FIG. 7 shows a block diagram of the circuit.

FIG. 7 shows a block diagram of the circuit. While the block diagram is shown with just pads 61-64, it could be expanded to include the front pad 70 as well as be configured with a greater or lesser number of pads. The sensors recognize punch intensity, and endurance tracking, calories burned, punches registered, and workout time elapsed. In this figure each pad 61-64 is shown with a separate sensor 81-84 and a separate light 86-89. In the preferred embodiment the lights 86-89 are LED's that light all, a ring or other portion of the pad(s) 61-64. The controller 80, connected to a power supply 75, can randomly illuminate one or two targets 61-64 and 70 for a user to observe and strike or punch.

The controller 80 can send a wireless signal 67 through a transmitter/receiver 69 with an antenna 68. The signal can then be received by an antenna 77 connected to a transmitter/receiver 78 on a computer, phone or tablet 79 for accumulation and tabulation and display. It is also contemplated that the controller 80 can be connected to a speaker 76 that can provide audible feedback directly from the shin structure. The controller can also provide vibration or music integration.

Figure 8:
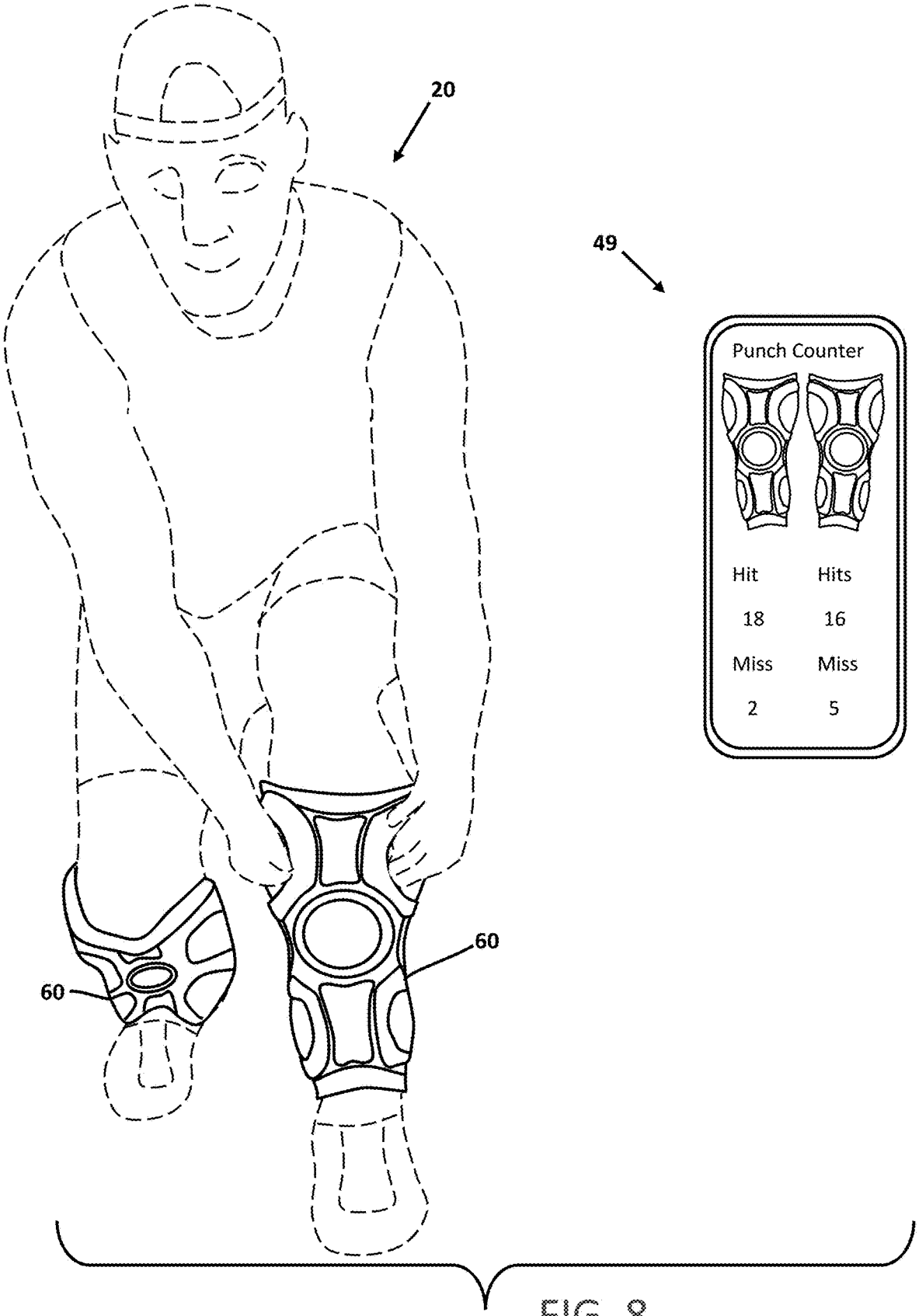
FIG. 8 shows the punching targets on a user.

FIG. 8 shows the punching targets shin structure 60 on a user 20. In this figure user 20 is shown punching multiple targets on their lower left leg. The information is shown here sent to a mobile device like a cell phone 49 where the intended impact(s) and actual impact(s) can be observed, played back and accumulated for accuracy. The order and sequence of punching the targets can be set by the controller in the shin structure and/or by the mobile device, cell phone 49 or computer. In the preferred embodiment the communication is with Bluetooth but could be Wi-Fi or other wired or wireless communication mechanism.

It is further contemplated that the order of punching can be from viewing a movie or other visual identifier for a user to follow. The impact counter can measure power, speed, punch accuracy and punching power. Each workout can be stored a date, time, frequency and workout milestone progress. The workouts can be linked between multiple local and distal users to create competition between users.

Thus, specific embodiments of a calf secured sit-up punching targets have been disclosed. It should be apparent, however, to those skilled in the art that many more modifications besides those described are possible without departing from the inventive concepts herein. The inventive subject matter, therefore, is not to be restricted except in the spirit of the appended claims.

The invention claimed is:

1. Calf secured punching targets comprising:

a curved semi-rigid shin structure that is configured to secure around a shin and calf of a user;

said curved skeletal structure having at least two targets;

said at least two targets having separate sensors configured for detecting impact from said user when at least one of said at least two targets is punched by said user when said user is performing a sit-up;

said separate sensors are connected to a controller that measures said detected impact on each of said at least two targets;

said controller configured to communicate with a separate wireless device, wherein the separate wireless device comprises a phone, computer or tablet that accumulates information related to said detected impact.

2. The calf secured punching targets according to 1, wherein said at least two targets each have separate illumination lights.

3. The calf secured punching targets according to 2, wherein said separate illumination lights are independently controllable.

4. The calf secured punching targets according to 3, wherein said illumination lights are controlled by said controller.

5. The calf secured punching targets according to 4, wherein said controller is configured to communicate with said separate wireless device over Wi-Fi or Bluetooth or a cellular network.

6. The calf secured punching targets according to 5, wherein said phone, said computer or said tablet records at least one of a date, a time, a frequency, and a workout duration.

7. The calf secured punching targets according to 1, further comprising a washable lining.

8. The calf secured punching targets according to 7, wherein said washable lining is constructed from an antimicrobial material that reduces odor, mold and bacteria.

9. The calf secured punching targets according to 1, wherein said curved skeletal structure has at least five targets.

10. The calf secured punching targets according to 1, wherein said controller is connected to a sound producing device.

11. The calf secured punching targets according to 1, wherein said controller measures impact on said separate sensor of one of said at least two targets to determine at least one of a power, a punch accuracy, a number of punches, an elapsed time, a time between punches and a speed to punch said target.

12. The calf secured punching targets according to 1, further comprising a hook-and-loop securing mechanism.

* * * * *